US007451560B2

(12) United States Patent
Kodde et al.

(10) Patent No.: US 7,451,560 B2
(45) Date of Patent: Nov. 18, 2008

(54) HOLDER, WALL PROVIDED WITH A HOLDER, AND METHOD

(76) Inventors: Johan Frederik Kodde, Plantage Muldergracht 161, 1018 TT Amsterdam (NL); Otto-Jan Staleman, Vossiusstraat 60, 1071 AK Amsterdam (NL)

( * ) Notice: Subject to any disclaimer, the term of this patent is extended or adjusted under 35 U.S.C. 154(b) by 173 days.

(21) Appl. No.: 11/314,232

(22) Filed: Dec. 22, 2005

(65) Prior Publication Data

US 2007/0144048 A1 Jun. 28, 2007

(51) Int. Cl.
*G09F 3/18* (2006.01)

(52) U.S. Cl. ..... 40/652; 211/51

(58) Field of Classification Search ..... 40/652, 40/657, 124, 658, 740; 211/90.01, 90.04, 211/50–51, 59.3; 108/60; 206/556; 221/56, 221/279; 248/473

See application file for complete search history.

(56) References Cited

U.S. PATENT DOCUMENTS 3,267,546 A * 8/1966 Kraft ..... 24/561
4,938,366 A * 7/1990 Carroll ..... 211/55
5,394,996 A 3/1995 Carpenter
5,485,926 A 1/1996 Kundert
5,727,696 A * 3/1998 Valiulis ..... 211/51
6,209,730 B1 4/2001 Ewing
6,749,071 B2 * 6/2004 Caterinacci ..... 211/40

FOREIGN PATENT DOCUMENTS

CH 523 049 A 5/1972
DE 33 03 970 A 8/1984

* cited by examiner

*Primary Examiner*—William L. Miller
(74) *Attorney, Agent, or Firm*—Harness, Dickey & Pierce

(57) ABSTRACT

The present invention provides a holder for arranging against a wall one or more image carriers such as photos, cards, photo frames, brochures and the like, wherein the holder comprises:

a support member for placing along the wall;

a fixing member which is connected to the support member and can be arranged against the wall;

a first spacer, arranged at a suitable distance from the support member, for arranging the image carrier therein.

16 Claims, 2 Drawing Sheets

HOLDER, WALL PROVIDED WITH A HOLDER, AND METHOD

BACKGROUND OF THE INVENTION

The present invention provides for this purpose a holder for arranging against a wall one or more image carriers such as photos, cards, photo frames, brochures and the like, wherein the holder comprises:

Such a wall is to be found in most buildings, wherein it is possible to envisage a wall provided with horizontally running shelves on which objects can be arranged. Image carriers can be placed on the shelves, but can fall over due to a sudden draught. The whole moreover has a cluttered appearance and a shelf has been found to be more suitable for stable objects which are relatively thicker, such as books, than for image carriers.

SUMMARY OF INVENTION

The present invention has for its object to provide a wall provided with a holder which is better suited to image carriers.

The present invention provides for this purpose a holder for arranging against a wall one or more image carriers such as photos, cards, photo frames, brochures and the like, wherein the holder comprises:

- a fixing member for placing along the wall;
- a support member which is connected to the fixing member and can be arranged against the wall;
- a first spacer, arranged at a suitable distance from the fixing member, for arranging the image carrier therein.

The spacer has been found to be suitable for arranging an image carrier therein, wherein the movement in thickness direction is prevented so that the carrier remains in place in the case of draught. The image carrier is preferably slidable in the spacer. This thus allows the option of varying the placing of the image carrier in simple manner, which enables application as architectural element.

In a preferred embodiment the fixing member is a flange. This is found to enable a robust and durable fixing to a wall.

The holder preferably comprises a clamping element for fixedly clamping the image carrier in the spacer or groove. Image carriers with a thickness smaller than the width of the groove can thus still be clamped herein for greater stability. The image carrier is thus positioned in more stable manner and remains in place in the case of draught and the like.

In a further preferred embodiment, the clamping element is a U-shaped profile comprising a resilient lip which is arranged on an outer end of one of the standing walls of the U-shaped profile. This is found to still provide a robust clamping in simple manner.

In an advantageous embodiment, the spacer is a groove comprising side walls with an intermediate space of between 6 mm and 22 mm.

In yet another preferred embodiment, a first, a second and a third groove are arranged lying adjacently of each other on the carrier of the holder, wherein the first and the second groove have a common partition wall and wherein the second and the third groove have a common partition wall for the purpose of forming a double groove. This embodiment makes it possible to place image carriers one behind another or to slide them along one behind another. It is hereby easy to create variation or to partly conceal image carriers from view.

The first, second and/or third spacer preferably have different widths. The holder is thus found to be suitable for about 90% of existing photo frames.

The first spacer preferably has a width of about 22 mm, the second spacer a width of about 12 mm and/or the third spacer a width of about 6 mm.

According to a further aspect, the present invention provides a wall provided with a holder as described above.

According to yet another aspect, the present invention provides a method for manufacturing a holder substantially as according to any of the claims 1-10.

BRIEF DESCRIPTION OF THE DRAWINGS

Further advantages and features of the present invention will be described with reference to the annexed figures, in which.

DETAILED DESCRIPTION

A wall provided with a holder 1 according to the present invention is better suited for arranging of images thereon, wherein particularly photos, cards and frames must be envisaged.

Figure 1:
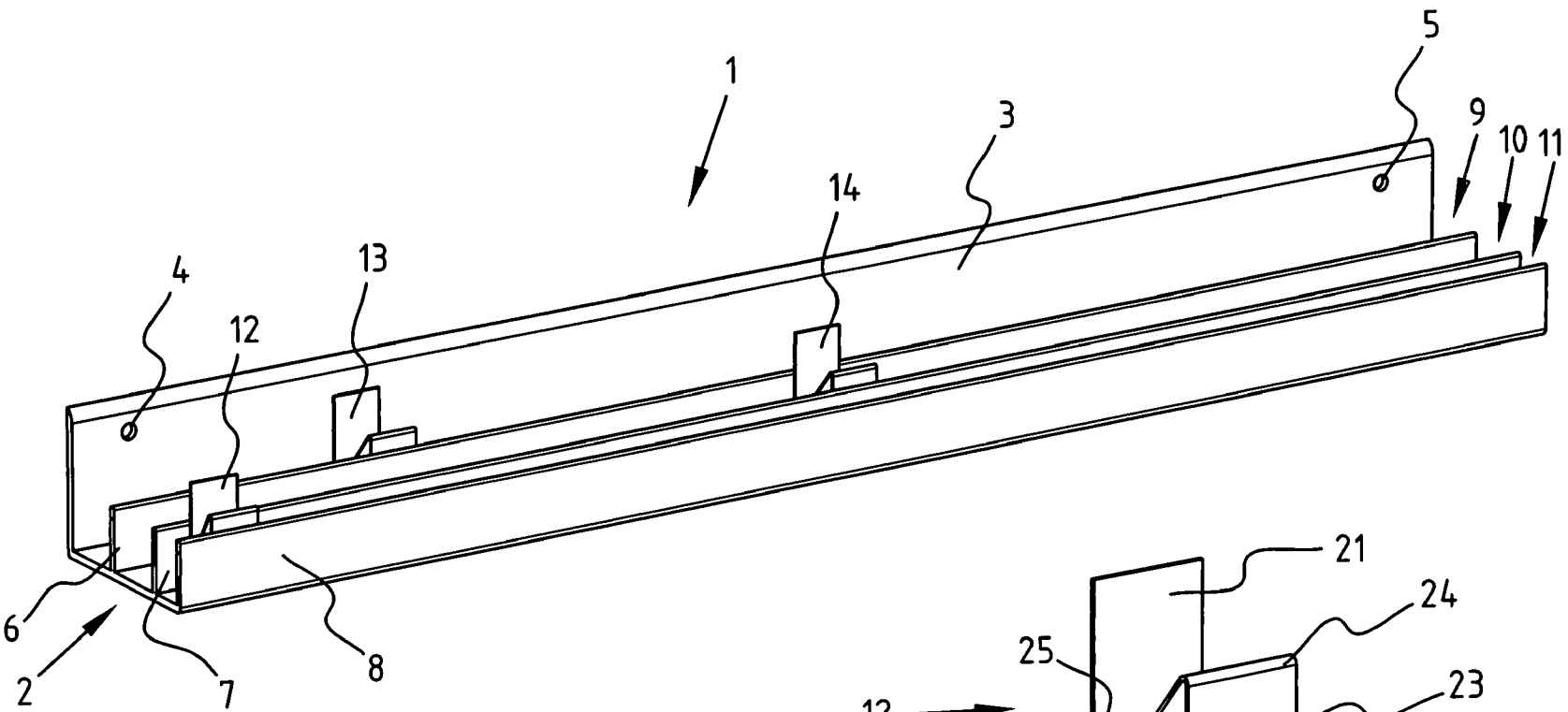
FIG. 1 shows a perspective view of a preferred embodiment of a holder provided with clamping elements.

Holder 1 comprises a support member 2 in the form of an elongate plate on which is arranged a fixing member, for instance a flange 3 running over the entire length of the support member and provided with holes 4, 5 for fixing holder 1 against a wall, using for instance nails or screws. The holder can also be arranged against the wall in other known ways, such as by glueing. Three upright flanges 6, 7 and 8 running mutually parallel over the whole length of the support member are arranged on support member 2 for the purpose of forming first, second and third elongate spacers or grooves 9, 10 and 11 respectively. Clamping elements 12, 13, 14 are preferably arranged in the grooves so that image carriers of a random thickness can be clamped fixedly in the grooves (FIG. 1). The holder can likewise be embodied without clamping element.

Figure 2:
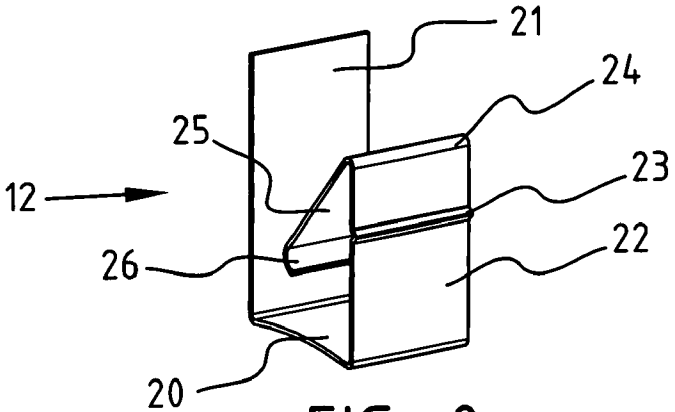
FIG. 2 shows a perspective view of a clamping element of FIG. 1.

Clamping element 12 is preferably formed by a bent profile (FIG. 2). Such a profile comprises a U-shaped part formed by a concave component 20 which is connected at the side edges to standing walls 21, 22. Wall 22 is provided with an edge 23 which runs over the whole width hereof and with which the clamping element 12 can be clamped fixedly in one of the grooves 9, 10, 11, see also FIG. 3. At the other outer end the wall 22 runs in a bend 24 and transposes at this point into a resilient lip 25 which is provided on the outermost end with bending edge 26 for the purpose of preventing damage to image carriers. Clamping element 12 can be manufactured in known manner from a suitable material such as spring steel.

Figure 3:
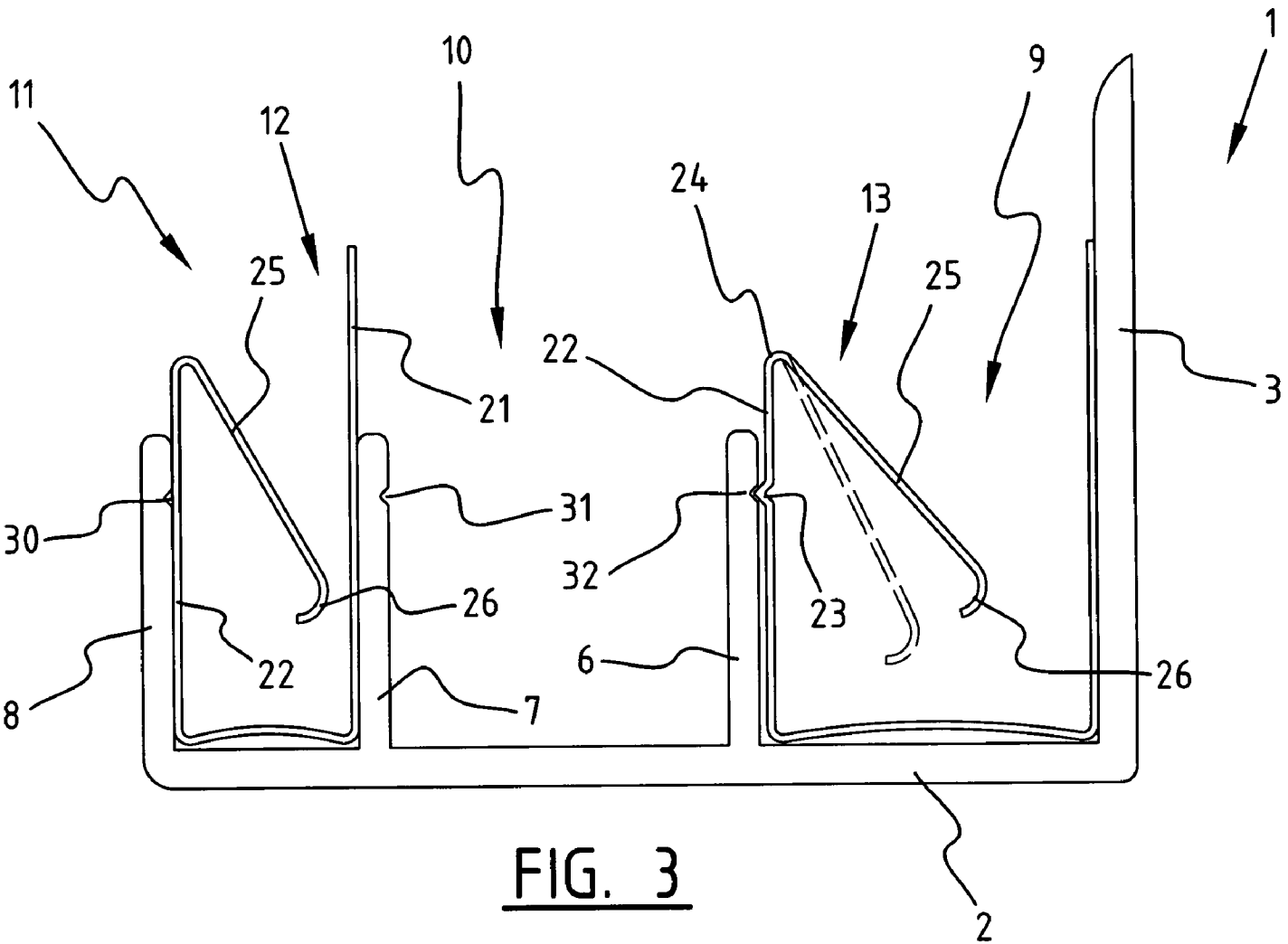
FIG. 3 is a side view of the holder of FIG. 1.

The clamping elements have a width substantially corresponding to the width of grooves 9, 10 or 11 (FIG. 3). The clamping elements preferably comprise a protruding edge 23 with which the element can be clamped into one of the notches 30, 31, 32 with a corresponding form. A clamping element can further be clamped in the groove due to the corresponding width, whereby protruding edge 23 can be omitted, as shown in FIG. 3 at groove 11.

Arranged against the wall the holder provides a clamping system for, among other objects, existing photo frames, wherein the width of grooves 9, 10, 11 is chosen such that the holder is suitable for practically 90% of existing photo frames, wherein these are clamped directly into one of the grooves with for instance a clearance in the order of 1 mm, or are fixedly clamped therein by means of one of clamps 12-14. Suitable widths for the grooves are for instance about 22 mm, about 12 mm and about 6 mm for the first, second and third groove respectively. This width can of course be chosen differently, for instance with a first groove having a width of 22 mm or greater. Some grooves can also have the same width.

The holder is preferably manufactured from extruded aluminium, whereby it is easy to manufacture and economically viable. It is further possible to supply a cheaper, simple version, as well as more expensive finishes, wherein lacquering, galvanizing and the like of the extruded profile must be envisaged. The profile can also be manufactured from other materials or metals for a more stylish appearance.

The present invention is not limited to the above described preferred embodiment thereof, in which many modifications are possible within the scope of the appended claims.

What is claimed is:

1. Holder for arranging against a wall one or more image carriers including photos, cards, photo frames, and brochures, the holder comprising:

a fixing member for placing along the wall;

a support member which is connected to the fixing member and extends outwardly therefrom;

a first flange connected to the support member, the first flange located on the end of the holder that opposes the fixing member;

a second flange, arranged at a suitable distance between the fixing member and the first flange, so as to form a first spacer and a second spacer for arranging the image carrier therein; and a clamping element positioned in at least one of the first and second spacers to fixedly clamp the image carrier in at least one of the first and second spacers, the clamping element including a u-shaped profile with two standing walls, wherein a resilient lip is arranged on an outer end of one of the standing walls to bias against the image carrier, the clamping element having a width substantially corresponding to a width of the at least one of the first and second spacers.

2. Holder as claimed in claim 1, also comprising a third flange arranged lying adjacently of the second flange, the third flange located between the second flange and the first flange and forming a third spacer.

3. Holder as claimed in claim 2, wherein at least one of the first, second and third spacers have different widths.

4. Holder as claimed in claim 2, wherein at least one of the first spacer has a width of about 22 mm, the second spacer a width of about 12 mm and the third spacer a width of about 6 mm.

5. Wall provided with the holder as claimed in claim 2.

6. Method for manufacturing the holder as claimed in claim 2.

7. Holder as claimed in claim 1, also comprising a third spacer lying adjacently of the second spacer, wherein the first and the second spacer are separated by the second flange and wherein the second and the third spacer are separated by a third flange arranged lying adjacently of the second flange.

8. Holder as claimed in claim 7, wherein at least two of the first, second and third spacers have different widths.

9. Holder as claimed in claim 1, wherein the first and second spacers have respective widths of about 6 mm and 22 mm.

10. Holder as claimed in claim 1, wherein the fixing member is a flange.

11. Holder as claimed in claim 1, wherein at least one opening is arranged in the fixing member for placing therethrough at least one fastener.

12. Holder as claimed in claim 11, the at least one fastener including at least one of a screw and a bolt.

13. Wall provided with the holder as claimed in claim 1.

14. Method for manufacturing the holder as claimed in claim 1.

15. Method as claimed in claim 14, wherein the support member, the fixing member, and the first and second flange are manufactured from an extrusion profile of aluminum brought to a predetermined length.

16. Holder as claimed in claim 1, further comprising a third spacer lying adjacently of the second spacer, wherein the first and the second spacer are separated by the second flange and wherein the second and the third spacer are separated by a third flange, the third flange located between the second flange and the first flange and forming the third spacer.

* * * * *